United States Patent [19]

Roeder et al.

[11] Patent Number: 4,859,104

[45] Date of Patent: Aug. 22, 1989

[54] APPLICATOR DEVICE AND CAP

[75] Inventors: Georg Roeder, Schwabach; Gerhard Moeck, Kirchenehrenbach, both of Fed. Rep. of Germany

[73] Assignee: Schwan-Stabilo Schwanhausser GmbH & Co., Nuremberg, Fed. Rep. of Germany

[21] Appl. No.: 121,160

[22] Filed: Nov. 16, 1987

[30] Foreign Application Priority Data

Dec. 4, 1986 [DE] Fed. Rep. of Germany ..... 3641389

[51] Int. Cl.[4] ..... B43K 9/00; B05C 1/02; A46B 11/00

[52] U.S. Cl. ..... 401/202; 401/243; 401/244; 401/245; 401/246; 401/262; 401/269

[58] Field of Search ..... 401/131, 202, 243, 244, 401/245, 246, 247, 262, 269

[56] References Cited

U.S. PATENT DOCUMENTS

| | | | |
|---|---|---|---|
| 2,547,803 | 4/1951 | Adams | 401/246 |
| 3,475,103 | 10/1969 | Danjczek | 401/243 |
| 3,862,683 | 1/1975 | Koelichen | 401/131 X |

FOREIGN PATENT DOCUMENTS 2509978 9/1976 Fed. Rep. of Germany .

*Primary Examiner*—Richard J. Apley
*Assistant Examiner*—Franklin Gubernick
*Attorney, Agent, or Firm*—Bachman & LaPointe

[57] ABSTRACT

An applicator, especially for applying nail varnish, is associated with a closing cap with a reservoir for keeping the coating member moist. Located in the closing cap is a closing element which, when the closing cap is pulled off the applicator, closes the space containing the reservoir in order to prevent the reservoir from drying out.

2 Claims, 3 Drawing Sheets

42
54
53
12
39
18
14
40
22"
52

42
44
48
12
40
39
14
22'
44
44
42
48
14
22'
50
44
44
50
22'

APPLICATOR DEVICE AND CAP

FIELD OF THE INVENTION

The invention relates to an applicator device having a closing cap with an open end and a closed end and intended for a coating member of the applicator means and containing, in a reservoir space located in the closed end, a moistened reservoir for keeping the coating member moist, there being in the closing cap a closing element movable between two positions of which in one it closes off the reservoir space towards the outside and in the other it opens the reservoir space towards the outside, the closing element being moved into the first position when the closing cap is pulled off from the applicator means and into the other position when the closing cap is attached onto the applicator.

PRIOR ART

An applicator device of this type is known from W. German Offenlegungsschrift No. 2,509,978. In this known applicator device, the closing element movable between two positions is equipped with a spring element in the form of a helical spring. However, after the applicator means has been in use for a long time such a helical spring shows signs of fatigue, and often it is possible that the helical spring will break. In these cases, there is no longer a guarantee that the reservoir space will be sealed off when the closing cap is detached from the applicator means.

OBJECT OF THE INVENTION

It is an object of the present invention to provide an applicator device of the above-mentioned general type, in which the positive movement of the closing element between the two possible positions remains reliably guaranteed even after the applicator means has been in use for a very long time.

SUMMARY OF THE INVENTION

Accordingly a first aspect of the present invention provides in a device comprising:.

(a) applicator means having a coating member;

(b) a closing cap having an open end and a closed end and intended for the coating member of the applicator means, said closing cap defining a reservoir space in said closed end;

(c) moistened reservoir means in said closing cap for keeping the coating member moist;

(d) a closing element in the closing cap movable between first and second positions, wherein when said closing element is in said first position it closes off the reservoir space from the outside and when said closing element is in the second position it opens the reservoir space to the outside; and (e) means moving the closing element into the first position when the closing cap is pulled off the applicator means and into the second position when the closing cap is attached onto the applicator means;

the improvement wherein:

(f) the closing cap includes a collar limiting the reservoir space towards said open end;

(g) the closing element is matched to the shape of the closing cap and can be shifted in the closing cap by means of the applicator means in the axial direction of the closing cap while remaining spaced from the inner wall of the closing cap in such a way that in the first position of the closing element, a bottom part closing the closing element at the end adjacent the reservoir rests against the collar to substantially seal the reservoir space and, in the second position of the closing element the bottom part of the closing element is shifted away from the collar towards the reservoir space over a specific distance; and (h) means defining perforations in the wall of the closing element in a portion thereof between the closed end of the closing element and said collar.

In this form of the applicator device there is no need to provide a spring element in order to shift the closing element between the two possible positions, that is to say between the opened position and the sealing-off position. To make this adjustment to the closing element, without difficulty and reliably at all times, it has proved expedient to provide a locking device effective between the closing element and the applicator means, the lock being releasable automatically when the closing cap is completely separated from the applicator means in the first position of the closing element, and the lock being engageable automatically when the other position of the closing element is reached during the attachment of the closing cap onto the applicator means.

A second aspect of the invention provides in a device comprising:

(a) applicator means having a coating member;

(b) a closing cap having an open end and a closed end and intended for the coating member of the applicator means, said closing cap defining a reservoir space in said closed end;

(c) moistened reservoir means in said closing cap for keeping the coating member moist;

(d) a closing element in the closing cap movable between first and second positions, wherein when said closing element is in said first position it closes off the reservoir space from the outside and when said closing element is in the second position it opens the reservoir space to the outside; and (e) means moving the closing element into the first position when the closing cap is pulled off the applicator means and into the second position when the closing cap is attached onto the applicator means;

the improvement wherein:

(f) the closing cap has an inner collar near its entry orifice;

(g) the closing element is a cap which second position surrounds the coating member and is closed, with the exception of the entry orifice, and is matched to the shape of the closing cap while remaining spaced from the inner wall of the closing cap;

(h) said closing cap has, at the entry orifice, an edge pressed by the applicator means when the closing cap is attached onto the applicator means; and (i) the closing cap has, between said edge and its closed end, an outwardly encircling annular shoulder interacting with the collar and located near said edge, and at least one radial perforation between said edge and the annular shoulder, the annular shoulder being shiftable in the axial direction of the closing cap by means of the applicator means in such a way that the annular shoulder rests against the collar of the closing cap, to ensure substantial sealing of the reservoir space, in said first position of the closing element and that the annular shoulder is separated from the collar in the other position of the closing element.

In this version of the applicator device, the closing element is shifted between the two positions because the cap-shaped closing element is made resilient along its casing portion. The resilient casing portion ensures a long service life in comparison with a helical spring, and consequently a fatigue-free spring effect, so that it is possible for this applicator means to have a virtually unlimited use. On the other hand, in such a design of the applicator device the sealing and opening of the reservoir space are achieved by simple means. The same purpose is served if (a) the closing element rests against a stop of the closing cap at the end located opposite the entry orifice for the coating member and is made elastic, and if (b), in the relaxed state of the closing element, the distance between the end of the closing element located opposite the entry orifice for the applicator means and the annular shoulder is equal to or greater than the distance between the stop of the closing cap and the collar of the closing cap.

A third aspect of the present invention provides in a device comprising:

(a) applicator means having a coating member;

(b) a closing cap having an open end and a closed end and intended for the coating member of the applicator means, said closing cap defining a reservoir space in said closed end;

(c) moistened reservoir means in said closing cap for keeping the coating member moist;

(d) a closing element in the closing cap movable between first and second positions, wherein when said closing element is in said first position it closes off the reservoir space from the outside and when said closing element is in the second position it opens the reservoir space to the outside; and (e) means moving the closing element into the first position when the closing cap is pulled off the applicator means and into the second position when the closing cap is attached onto the applicator means;

the improvement wherein:

(f) the closing cap has an inner collar near its entry orifice;

(g) the closing element is a cap which, in said second position, surrounds the coating member and is matched to the shape of the closing cap while remaining spaced from the inner wall of the closing cap;

(h) said closing element has at the closing cap entry orifice an edge pressed axially by the applicator means during the attachment of the closing cap onto the applicator means and interacting with the collar, this edge being movable axially of the closing cap by means of the applicator means in such a way that the edge rests against the collar to substantially seal the reservoir space in the first position of the longitudinally elastic closing element, and is separated from the collar in the other position of the closing element;

(i) the closing element rests against a stop of the closing cap at the end located opposite said closing cap entry orifice for the coating member;

(j) in the relaxed state of the closing element, the distance between the end of the closing element located opposite said closing cap entry orifice for the applicator means and said edge is no less than the distance between the stop of the closing cap and the collar of the closing cap; and (k) between said edge and said end of the closing element resting against the stop are means defining slits which open during the shortening of the closing element when the closing cap is attached onto the applicator means.

In this form of the applicator device too, the spring effect for shifting the closing element between the sealing position and the non-sealing position is achieved as a result of the cap-shaped design of the closing element, so that there is no need for additional spring elements. Thus, with such an applicator device the same advantages are obtained as in an applicator device of the aspects described above.

BRIEF DESCRIPTION OF THE DRAWINGS

Further details emerge from the following description of exemplary embodiments of the applicator according to the invention, shown in the accompanying drawings. In the drawings.

DESCRIPTION OF THE PREFERRED EMBODIMENT

Figure 1:
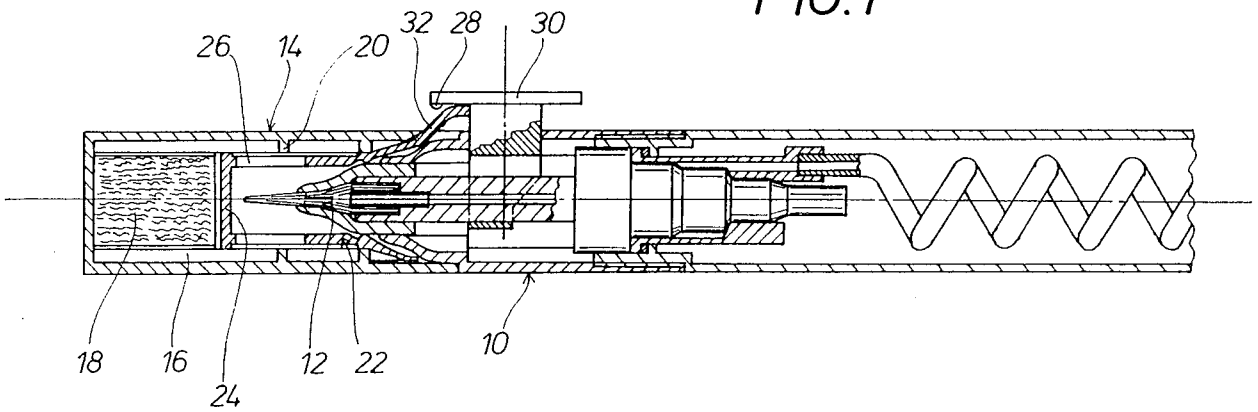
FIG. 1 is a longitudinal section through a first embodiment of the partially illustrated applicator.
Figures 2A, 2B, 2C, 2D:
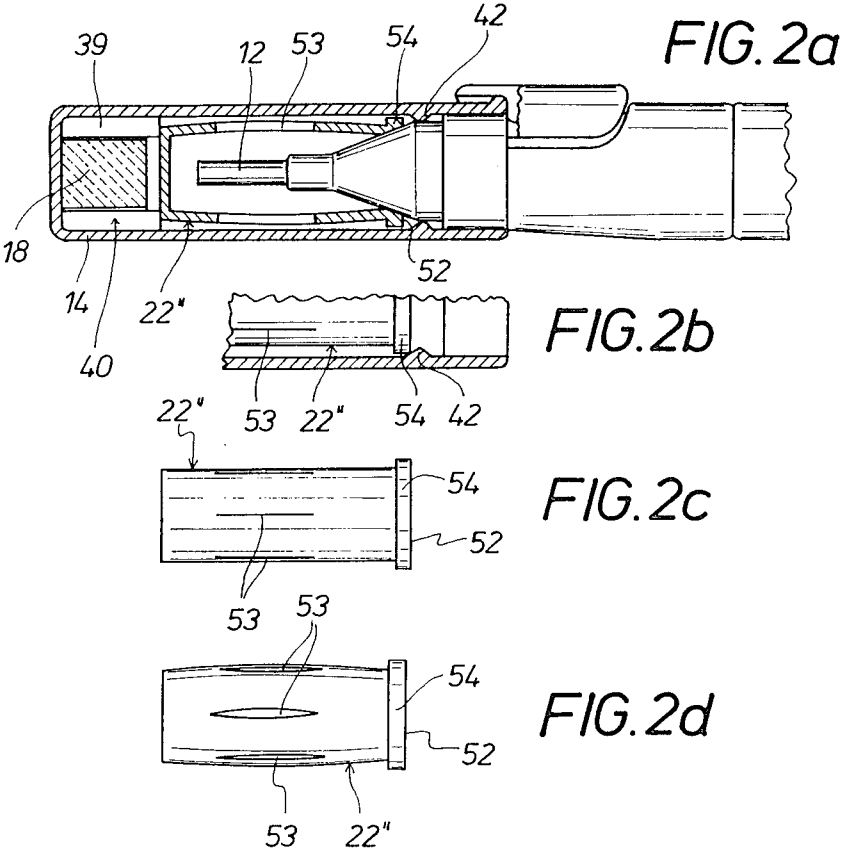
FIGS. 2*a* to 2*d* illustrate a second embodiment of the partially illustrated applicator, the closing cap and the closing element being shown in section or in a side view.
Figures 3A, 3B, 3C:
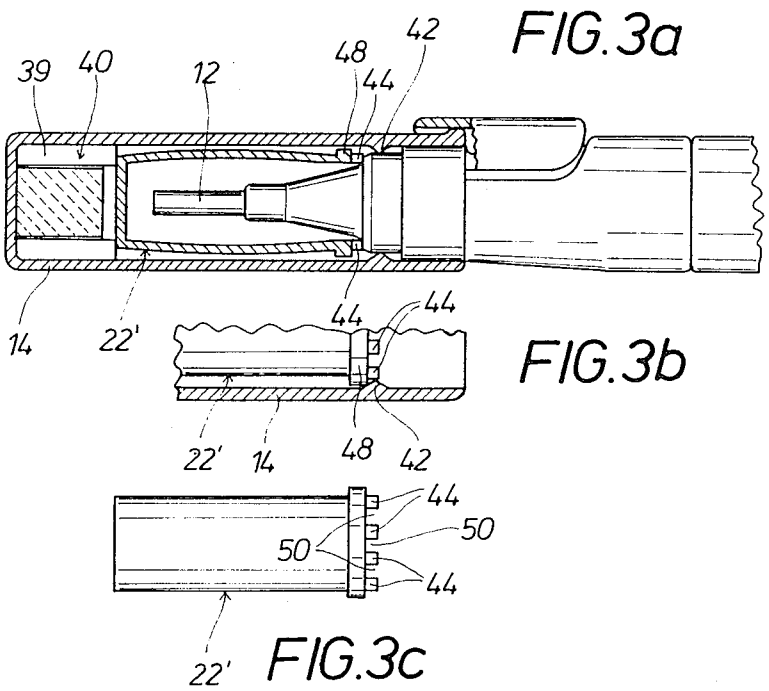
FIGS. 3*a* to 3*c* illustrate a third embodiment of the partially illustrated applicator, with a closing cap shown in section and the closing element in side elevation.

FIG. 1 shows, in section, an applicator for nail varnish. The applicator proper (without the closing cap) is referenced 10 whereas the closing cap intended to protect the coating member 12 of the applicator 10 is referenced 14. At its closed end the closing cap 14 has a reservoir space 16 in which is arranged a reservoir 18, for example a piece of felt, saturated with the coating fluid (e.g. nail varnish). The inner wall of the closing cap 14 has a collar 20 which limits the reservoir space 16 towards the outer end. As shown in FIG. 1, a tubular closing element 22 is movably mounted in the tubular closing cap 14. This tubular closing element is closed by means of a bottom part 24 at its end facing the reservoir whereas, like the closing cap 14, it is open at the opposite end. As shown, the bottom part 24 is located between the reservoir 18 and the collar 20 and projects slightly beyond the casing of the tubular body of the closing element 22 so that along its path of movement from the reservoir 18 to the collar 20 its projecting edge butts against the collar 20. The coating member 12 of the applicator 10 can be inserted into the tubular closing element 22. In FIG. 1, the closing cap 14 is attached to the applicator, and the closing element 22 is in its position in which the reservoir space 16 communicates with the outside, that is to say towards the interior of the closing element 22, by way of perforations 26 in the casing of the tubular body of the closing element 22 between its bottom part 24 and the collar 20 of the closing cap 14. When the applicator is removed from the closing cap the closing element 22 is carried rightwardly, as viewed in the drawing, until its bottom part 24 butts against the collar 20. However, the reservoir space 16 is then closed off from the interior of the closing element because the perforations 26 are then no longer open towards the reservoir space 16. The closing element 22 is carried along via a locking device 28 in the form of a mushroom-shaped pressbutton 30 of the applicator 10 and a lug 32 formed on the closing element 22 and resting against the underside of the mushroom-shaped pressbutton 30. Since this lug 32 is elastic (the applicator, including the closing cap, being usually made of plastic), this locking device is releasable automatically and the lock can be engaged automatically.

FIGS. *2a* to *2d* show a modified embodiment. There, the reservoir 18 is mounted on the inner periphery of the closing cap 14 between mutually spaced longitudinal ribs 39. These spaced longitudinal ribs 39 form a stop 40 for an elastic closing element 22" having at its open end an annular shoulder 54 with an edge 52 which, when the closing cap 14 is attached onto the applicator, is pressed axially leftwardly by the applicator, as shown in FIG. *2a*. When the closing cap 14 is pulled off the applicator, the edge 52 or the annular shoulder 54 comes up against a collar 42 of the closing cap 14, for a purpose to be explained later, and ensures an essentially sealed closure there. This situation is illustrated in FIG. *2b*.

The elastic closing element 22" is a little longer than the distance between the stop 40 and the collar 42 and has slits 53 which are closed in the configuration shown in FIG. *2b* (and also FIG. *2c*) and which are open in the configuration shown in FIG. *2a* (and also FIG. *2d*). In the latter configuration, that is to say when the slits 53 are open as a result of the forced shortening or compression of the closing element 22", the closing element 22" is in a bulged condition, as can be seen clearly in FIG. *2a*. In this state, the fluid vapor can pass from the reservoir 18 via the open slits 54 to the coating member 12, thus preventing it from drying out.

When the closing cap 14 is pulled off the applicator, the slits 53 close and the edge 52 of the closing element 22" rests against the collar 42, thereby preventing the reservoir from drying out as a result of the escape of moisture to the atmosphere.

FIGS. *3a* to *3c* illustrate a further embodiment which differs essentially in that, instead of the slits in the annular shoulder which here bears the reference 48, there are teeth which form an edge 44, interacting with the applicator, as shown in FIG. *3a*. Perforations 50 are provided between the teeth. When the closing cap 14 is attached to the applicator, the annular shoulder 48 is pressed away from the collar 42 as shown in FIG. *3a*, so that moisture can pass from the reservoir 18 via the in the perforations 50 to the coating member 12.

When the closing cap 14 is detached from the applicator, the annular shoulder 48 comes up against the collar 42 and closes with sufficient sealing, so that no moisture can pass from the reservoir 18 into the atmosphere. This closed configuration is shown in FIG. *3b*.

We claim:

1. In a device comprising:

(a) applicator means having a coating member at an end;

(b) a closing cap having an open end defining an entry orifice and a closed end, said cap sealingly covering said end of said applicator means and thereby also covering the coating member of the applicator means, said closing cap defining a reservoir space in said closed end;

(c) moistened reservoir means in said reservoir space of said closing cap for keeping the coating member moist;

(d) a closing element in the closing cap movable between first and second positions, an open area within the closing element which surrounds the coating member when the closing element is in said second position, wherein when said closing element is in said first position it closes off the reservoir space from the open area and when said closing element is in the second position it opens the reservoir space to the open area; and (e) a means for moving the closing element into the first position when the closing cap is pulled off the applicator means whereby insertion of the applicator into the cap moves the closing element to the second position;

the improvement wherein:

(f) the closing cap has an inner collar near its entry orifice and a stop located opposite said entry orifice;

(g) the closing element is a longitudinally elastic cap which, in said second position, surrounds the coating member, is shortened and is matched to the shape of the closing cap while remaining spaced from the inner wall of the closing cap;

(h) said closing element has at the closing cap entry orifice an edge pressed axially by the applicator means during the attachment of the closing cap onto the applicator means and interacting with the collar, this edge being movable axially of the closing cap by means of the applicator means in such a way that the edge rests against the collar to substantially seal the reservoir space in the first position of the longitudinally elastic closing element, and is separated from the collar in the other position of the closing element;

(i) the closing element has as end located opposite to the closing cap entry orifice, wherein the closing element end rests against the stop of the closing cap at the end located opposite said closing cap entry orifice for the coating member;

(j) in the relaxed state of the closing element, the distance between the end of the closing element and said edge is no less than the distance between the stop of the closing cap and the collar of the closing cap; and (k) between said edge and said end of the closing element resting against the stop are means defining slits which open during the shortening of the closing element when the closing cap is attached onto the applicator means.

2. An applicator device as claimed in claim 1, wherein said edge is provided on an annular shoulder of said closing element.

* * * * *